United States Patent [19]

Oke

[11] Patent Number: 4,913,496

[45] Date of Patent: Apr. 3, 1990

[54] STACKABLE CHAIR AND METHOD OF MANUFACTURE

[76] Inventor: George V. Oke, 6718 Kerns Rd., Falls Church, Va. 22042

[21] Appl. No.: 327,028

[22] Filed: Mar. 22, 1989

[51] Int. Cl.[4] ..... A47C 1/12

[52] U.S. Cl. ..... 297/443; 297/297; 297/445

[58] Field of Search ..... 297/451, 297, 443, 444, 297/441, 445, 440; 248/188, 188.1, 188.91

[56] References Cited

U.S. PATENT DOCUMENTS

| | | | |
|---|---|---|---|
| 1,674,220 | 7/1928 | Percival | 297/443 |
| 2,408,337 | 9/1946 | Panzer | 248/188.91 X |
| 2,456,794 | 12/1948 | Richardson | 297/443 |
| 2,467,664 | 4/1949 | Glenn | 294/443 |
| 2,558,022 | 6/1951 | Wallance | 297/451 X |
| 3,000,669 | 9/1961 | Silverman | 297/451 |
| 3,111,344 | 11/1963 | Hoven et al. | 297/445 |
| 4,066,295 | 1/1978 | Severson | 297/443 |
| 4,113,312 | 9/1978 | Skalka | 297/454 |
| 4,768,833 | 9/1988 | Virtue | 297/444 |

FOREIGN PATENT DOCUMENTS

| | | | |
|---|---|---|---|
| 745871 | 3/1956 | United Kingdom | 297/451 |
| 2072004 | 9/1981 | United Kingdom | 297/445 |

*Primary Examiner*—James T. McCall

*Attorney, Agent, or Firm*—Shlesinger & Myers

[57] ABSTRACT

A chair comprises a ground supported frame having an upper planar surface. A recess portion is formed in the frame interrupting the upper surface. An L-shaped bracket has a first portion extending parallel to the surface and positioned within the recessed portion and a second portion extending upwardly therefrom generally transverse thereto. The first portion is secured within the recessed portion.

15 Claims, 2 Drawing Sheets

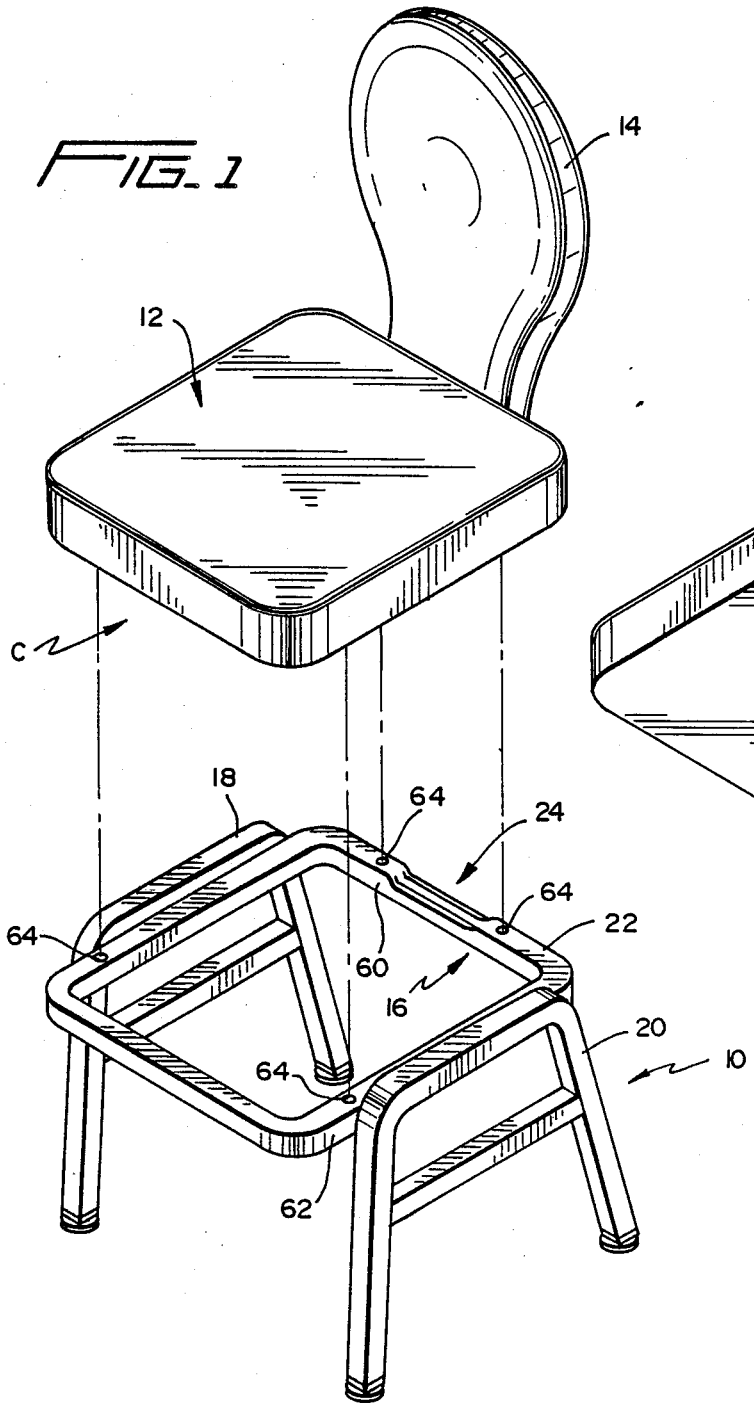
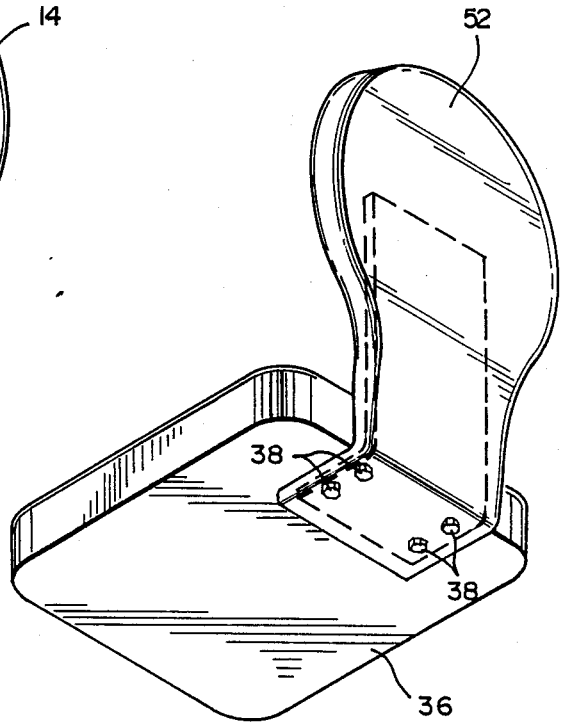
FIG. 2

FIG. 3
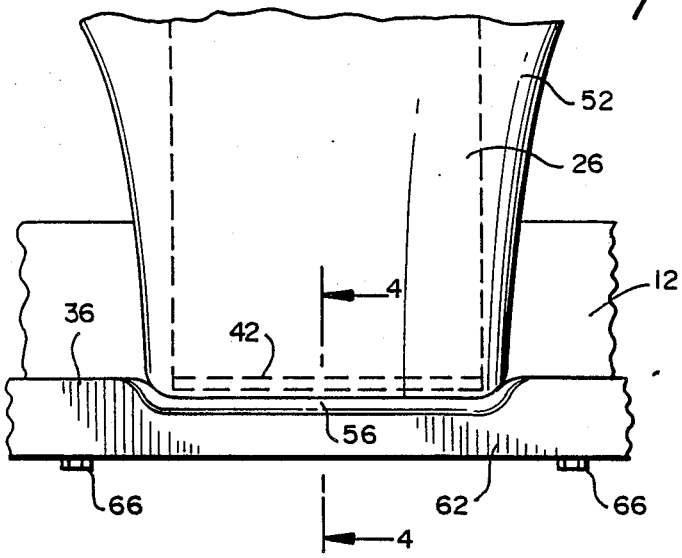
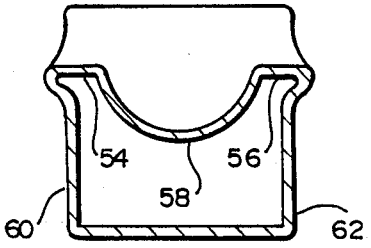
FIG. 4
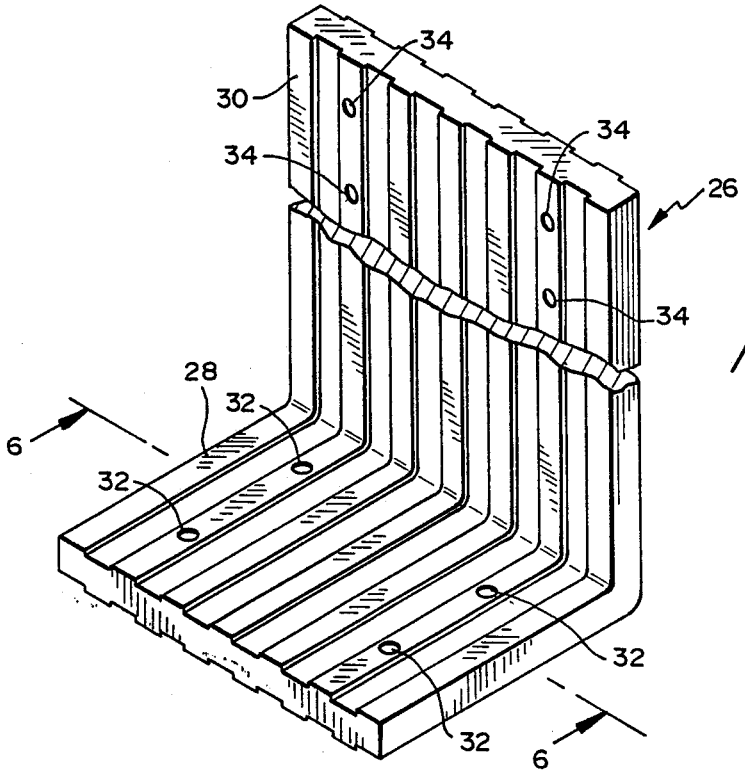
FIG. 5
FIG. 6
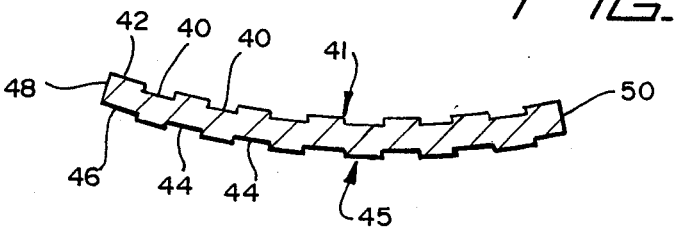

STACKABLE CHAIR AND METHOD OF MANUFACTURE

BACKGROUND OF THE INVENTION

A stackable chair is one which may be placed upon a like lower chair, and upon which a like chair may be placed to provide a stack of chairs. Stackable chairs are used in restaurants, auditoriums, and like places having a need to permit the seating configuration of a room to be readily changed as needs dictate.

It is not unusual for a stack of chairs to be moved from one location to another within or without the room. The stack can be quite heavy, and the weight of the chairs limits the number of chairs in a stack.

Also, many people prefer a chair having a back which is movably held to the ground supported frame and seat cushion. Movability is desired in order to permit the chair to accommodate itself to the user. This is particularly desirable when the user will remain seated for an extended period of time. A movably mounted back helps to alleviate user discomfort.

Those skilled in the art appreciate that there is a need for a stackable chair which has reduced weight in order to facilitate movement of the stack within and without the room. Also, the stackable chair should have a movably mounted back to minimize discomfort to the user. The disclosed invention is just such a chair, and one which is assembled through a unique manufacturing process.

OBJECTS AND SUMMARY OF THE INVENTION

The primary object of the disclosed invention is to provide a stackable chair having reduced weight.

An additional object of the disclosed invention is to provide a stackable chair having a back support resiliently secured to the ground supported frame in order to minimize discomfort to the user.

A seating structure pursuant to the invention comprises a ground supported frame having an upper planar surface. A recessed portion is disposed in the frame interrupting the upper surface. An L-shaped bracket assembly has a first portion extending parallel to the surface and positioned within the recessed portion, and a second portion extending upwardly therefrom generally transverse thereto. Means secure the first portion in the recessed portion.

A chair pursuant to the invention comprises a tubular rectangular support having an upper planar surface, and spaced side surfaces extending downwardly therefrom. First and second tubular support legs are provided, and the support legs are secured to the tubular support along opposite sides thereof along an upper portion of each support leg. A recessed portion is disposed in the support intermediate the support legs, and the recessed portion extends through and between the associated side surfaces and interrupts the upper surface. A seat cushion is provided. An L-shaped flexible bracket is provided, and a first portion of the bracket is secured to the cushion and a second portion thereof extends upwardly therefrom and generally transverse thereto. The first portion is positioned in the recessed portion so that the first portion extends parallel to the upper planar surface and the cushion rests flat on the upper surface. A back cushion is secured to the second portion.

The method of securing a cushion to a support comprises the steps of providing a ground supported tubular support having a planar upper surface. A portion of the support is deformed so that the upper surface is interrupted by a recess. A generally L-shaped bracket is provided, and the bracket has a first portion secured to a seat cushion and a second portion extending generally upwardly therefrom and generally transverse thereto. The first portion is positioned in the recess so that the cushion rests flat on the upper surface. The cushion is then secured to the upper surface.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a perspective view of a chair pursuant to the invention;

FIG. 2 is a bottom perspective view illustrating the seat cushion and back cushion thereof and with portions shown in phantom;

FIG. 3 is a fragmentary rear elevational view;

FIG. 4 is a cross-sectional view, taken along the line 4—4 of FIG. 3 and viewed in the direction of the arrows;

FIG. 5 is a perspective view of the seat bracket of the invention with broken lines indicating indeterminate length; and, FIG. 6 is a cross-sectional view taken along the line 6—6 of FIG. 5 and viewed in the direction of the arrows.

DESCRIPTION OF THE INVENTION

Stackable chair C, as best shown in FIG. 1, comprises a ground supported tubular base 10 to which fabric covered seat cushion 12 and fabric covered back cushion 14 are secured. While the chair C is disclosed as being a stackable chair, those skilled in the art will understand that the invention may also be utilized in a bench, lounge chair or like seating structure.

Ground supported base 10 has a rectangular tubular support 16 to which tubular legs 18 and 20 are secured by welding or the like. Each of the legs 18 and 20 is secured to an exterior surface of the tubular support 16. The support 16 has an upper planar surface 22 which is interrupted by recessed portion 24 intermediate legs 18 and 20. I prefer that the base 10 be formed of tubular members in order to minimize weight.

Bracket 26, as best shown in FIG. 5, is L-shaped and has a first portion 28 and a second portion 30 integral therewith and extending generally transverse thereto. First portion 28 has apertures 32 therethrough, while apertures 34 are formed in second portion 30. The apertures 32 are for securing the first portion 28 to lower surface 36 of seat cushion 12 by bolts 38, as best shown in FIG. 2. Likewise, bolts extend through the apertures 34 for securing back cushion 14 to second portion 30. While I have disclosed the bracket 26 bolted to the rear cushion 14, those skilled in the art will appreciate that the bracket 26 could be integral with back cushion 14, such as through a molding process.

The bracket 26, as best shown in FIGS. 5 and 6, has a plurality of grooves 40 in major surface 42 thereof.

Like grooves 44 are formed in the opposite major surface 46. The grooves 40 and 44 are aligned, and a projecting ridge 41 and 45 is thereby provided between each of the grooves 40 and 44, respectively. The grooves 40 and 44 and the associated projecting ridges 41 and 45 provide strength for the bracket 26, particularly as the bracket is flexed.

The bracket 26 is, preferably, formed of aluminum, Grade 6061. An acceptable Grade 6061 aluminum is sold by Reynolds Metals Inc. I prefer that the aluminum be tempered, preferably by a shot peening process. A T-6 temper is preferred. Also, the bracket should be approximately 0.25 inches in thickness. Although I prefer that the bracket 26 be formed of aluminum, it is within contemplation that it could be manufactured from a suitable plastic material, or like metal having the desired strength and flexibility characteristics.

Bracket 26, as best shown in FIG. 6, is arced between the ends 48 and 50 thereof, with the arc facing toward the lower surface 36 of seat cushion 12, and towards the rear surface 52 of cushion 14. In this way, the bracket 26 is under tension when secured to the cushion 12 and 14, thereby further tending to increase the strength and assure appropriate flexibility.

Recessed portion 24 is formed in tubular support 16 through a punch and die process. I prefer that the recessed portion 24 have a pair of oppositely disposed parallel ribs 54 and 56 between which a downwardly disposed arcuate portion 58 extends, as best shown in FIGS. 1 and 4. The flat upper surface provided by the ribs 54 and 56 in combination with the arcuate portion 58 assures that the recessed portion 24 has adequate strength for supporting the rear cushion 14 and the bracket 26 during flexing thereof. The recessed portion 24 is approximately 5 inches in length, and the recess interrupts planar surface 22 and extends between inner surface 60 and outer surface 62 of the tubular support 16.

The distance between the coplanar surfaces 54 and 56 and the upper surface 22 is no less than the thickness of the bracket 26 between the major surfaces 42 and 46 thereof. This assures that the lower surface 36 of cushion 12 rests flat on upper surface 22 throughout its length, thereby providing good attachment of the cushion 12 to the support 16. It can be noted in FIG. 3 that a portion of the fabric covering the rear surface 52 is folded under portion 28 of bracket 26. The distance between the surfaces 54 and 56 and the upper surface 22 is still sufficient to maintain alignment of major surface 42 with the upper surface 22 as the bracket is seated in the recess 24.

It can be appreciated from FIG. 3 that first portion 28 of bracket 26 is nestled in recessed portion 24 and extends therethrough parallel to upper surface 22. Second portion 30, on the other hand, extends upwardly therefrom and generally transverse thereto for securing the back cushion 14. The support 16 has apertures 64 therein through which suitable fastening means, such as bolts 66, extend for securing the cushion 12 thereto. This assures that the bracket 26 is firmly secured to the support 16, and yet permits some rocking action of the back cushion 14.

I have found that the aluminum bracket 26 decreases the weight of the chair C by an amount sufficient to increase the usability thereof. The decreased weight permits the stack to have a greater number of chairs than was available before, and yet provides a chair of extreme comfort. This is because the back cushion 14 may rock relative to the seat cushion 12, in a firm manner.

While this invention has been described as having a preferred design, it is understood that it is capable of further modifications, uses and/or adaptations following in general the principle of the invention, and including such disclosure therefrom as fall within the relevant art and within the scope of the claims appended hereto.

What I claim is:

1. A seating structure, comprising:

(a) a ground supported frame having an upper planar surface;

(b) a recessed portion in said frame interrupting said upper surface;

(c) an L-shaped bracket means has a first portion extending parallel to said surface and positioned within said recessed portion and a second portion extending upwardly therefrom generally perpendicular thereto;

(d) means for securing said first portion in said recessed portion;

(e) said recessed portion including two spaced parallel ribs extending parallel to said upper surface;

(f) each of said ribs including an upper flat surface, said flat surface of each of said ribs lie on a common plane;

(g) said frame including a portion having a longitudinal axis; and (h) said ribs extending parallel to said longitudinal axis.

2. The structure of claim 1, wherein said means for securing includes:

(a) a seat overlying said first portion and secured to said upper surface; and, (b) means extending from said first portion in engagement with said seat.

3. The structure of claim 1, wherein:

(a) said recessed portion includes a downwardly disposed arcuate portion interconnecting said flat surfaces.

4. The structure of claim 1, wherein said frame comprises:

(a) a tubular support providing said upper surface;

(b) first and second spaced side supports, each of said side supports is secured to said tubular support at an upper portion thereof; and, (c) said recessed portion is disposed between said side supports.

5. The structure of claim 1, wherein:

(a) said L-shaped bracket means is comprised of metal.

6. The structure of claim 5, wherein:

(a) said metal bracket means has first and second spaced exterior major surfaces, and a plurality of spaced parallel ribs are formed in each major surface for strengthening said bracket means.

7. The structure of claim 6, wherein:

(a) said first and second portions have arcuate portions, and the associated first and second major surfaces are correspondingly curved.

8. The structure of claim 5, wherein:

(a) said bracket means is comprised of tempered aluminum so that said second portion may flex relative to said first portion.

9. The structure of claim 1, wherein:

(a) the distance between said flat surfaces and said upper surface is not less than the thickness of said bracket first portion so that said bracket first portion is not disposed above said upper surface.

10. A chair, comprising:

(a) a tubular rectangular support having an upper planar surface and spaced side surfaces extending downwardly therefrom;

(b) first and second tubular support legs, said support legs secured to said tubular support along opposite sides thereof along an opposite portion of each support leg;

(c) a recessed portion disposed in said support intermediate said support legs, said recess portion extending through and between the associated side surfaces for thereby interrupting said upper surface;

(d) a seat cushion;

(e) an L-shaped flexible bracket, a first portion of said bracket is secured to said cushion and a second portion thereof extends upwardly therefrom and generally perpendicular thereto;

(f) said first portion positioned in said recessed portion so that said first portion extends parallel to said upper surface and said cushion rests on said upper surface;

(g) a back cushion secured to said second portion;

(h) said recessed portion including first and second spaced parallel ribs extending parallel to said upper planar surface, each of said ribs is proximate an associated side surface;

(i) each of said ribs including an upper flat surface, said flat surface of each of said ribs lie on a common plane;

(j) said support including a portion having a longitudinal axis; and (k) said ribs extending parallel to said longitudinal axis.

11. The chair of claim 10, wherein:

(a) said upper flat surfaces of said ribs are spaced from said upper surface by a distance not less than the thickness of said first portion so that said first portion does not extend upwardly beyond said upper surface.

12. The chair of claim 10, wherein:

(a) said bracket is comprised of metal and has spaced first and second major surfaces; and, (b) a plurality of ribs are disposed in each major surface for strengthening said bracket.

13. The chair of claim 12, wherein:

(a) said bracket includes first and second side surfaces; and, (b) a portion of each bracket portion is arcuate between said first and second side surfaces in order to place the associated bracket portion under tension when secured to the associated cushion.

14. The chair of claim 12, wherein:

(a) said bracket is comprised of tempered aluminum.

15. The chair of claim 11, wherein:

(a) a downwardly disposed arcuate section extends between said upper flat surfaces.

* * * * *